9/27/83 OR MECH SR 4,406,242

United States Patent [19]

Weeks

[11] 4,406,242

[45] Sep. 27, 1983

[54] OCEANOGRAPHIC SENSOR SYSTEM

[76] Inventor: Colin G. Weeks, 2014 Fernspray La., Houston, Tex. 77084

[21] Appl. No.: 242,449

[22] Filed: Mar. 11, 1981

[51] Int. Cl.[3] ..... B63B 21/56

[52] U.S. Cl. ..... 114/242

[58] Field of Search ..... 114/270, 244, 242, 240 R, 114/240 A; 367/88, 91, 106, 110, 112, 130

[56] References Cited

U.S. PATENT DOCUMENTS

| | | | |
|---|---|---|---|
| 1,148,103 | 7/1915 | Lobato | 114/240 D |
| 2,314,781 | 3/1943 | Ganis | 114/240 R |
| 4,247,923 | 1/1981 | Kok | 367/110 |

OTHER PUBLICATIONS

Krupp Atlas-Elektronik, "Atlas-Bottom Mopping Recorder", p. 1, 5-11, 36.

Ross Laboratories, "Channel Sweeping/Profile System," pp. 1-4.

*Primary Examiner*—Trygve M. Blix

*Assistant Examiner*—Jesus D. Sotelo

*Attorney, Agent, or Firm*—Arnold, White & Durkee

[57] ABSTRACT

An apparatus and method for supporting an oceanographic sensor system employing a frame indirectly attached to a vessel so as to follow the forward motion of the vessel, one or more floats independently supporting the frame, and one or more sensors mounted on the frame. In one embodiment the apparatus is used as a hydrographic survey system and includes an A-frame attached to and projecting over the bow of a vessel, a boom, two or more catamarans rotatably attached to the boom, two or more Kevlar lines extending from the apex of the A-frame to tow points above the point where the catamarans are attached, two or more nylon lines attached at one end to the tow points and at the other end to the side of the vessel such that the Kevlar and nylon lines act in conjunction to pull the boom along the vessels path and one or more transducers rotatably mounted on said boom. In another embodiment, a data processor and a computer are linked to the transducers of a hydrographic survey system so as to produce a sounding including a depth measurement for each position on the bottom and a display linked to the data processor and computer such that the depth of each position is identified by a unique color.

5 Claims, 5 Drawing Figures

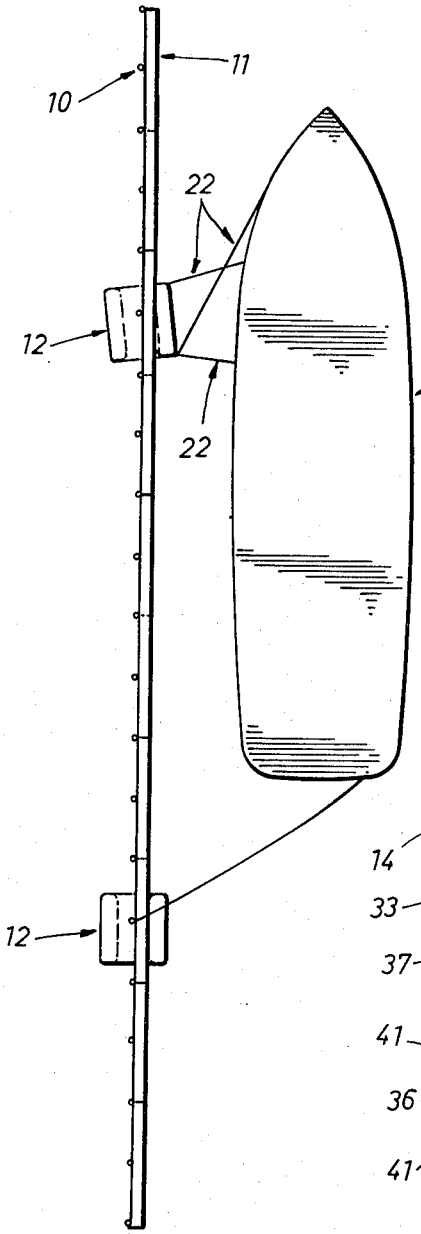
Fig. 3
Fig. 4
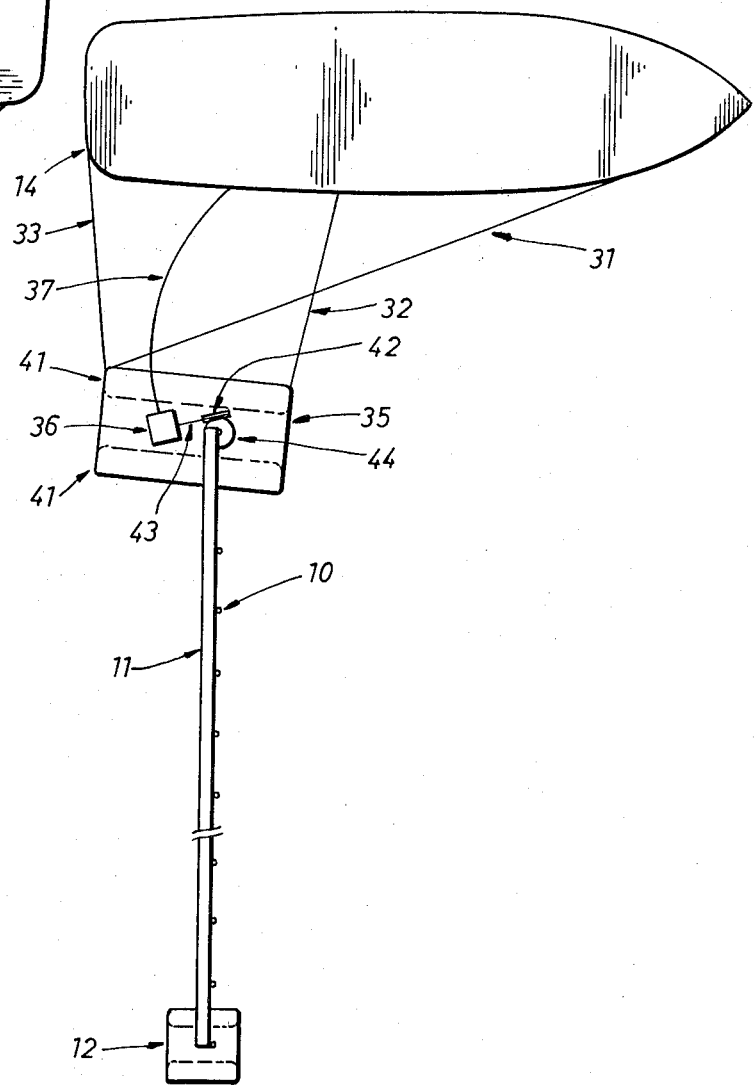

OCEANOGRAPHIC SENSOR SYSTEM

BACKGROUND OF THE INVENTION

The present invention relates to an oceanographic sensor system and technique and more particularly to a sensor mounting system and technique wherein the sensors, such as transducers, are indirectly attached to a vessel and independently supported by floats.

Hydrographic surveys have traditionally been conducted by running a survey boat in parallel lines across the area to be surveyed. Since World War II, survey vessels have incorporated sonar (sound navigation and ranging) type systems, which measure depth by employing transducers which emit and receive sounds reflected from the bottom. Although the use of a transducer equipped system is clearly beneficial, problems remain. For example, as the survey vessel travels in parallel lines and the distance between each line is a function of the number of passes a ship is able to make in a given area, various bottom features, such as isolated pinnacles, wrecks and other obstructions, if not entire areas, remain uncharted, absent an excessive number of passes by the survey vessel. Consequently, there is an increasing interest in the use of "swath" sounding systems in which an array of transducers are deployed perpendicular to the direction of the vessel's travel such that a "swath" is surveyed at each pass of the vessel. Unfortunately, previously developed swath sounding systems have suffered from one or more defects which prevent their wide acceptance.

Previously, the transducers were normally mounted on booms ranging in length from 30 to 50 feet and hinged to the side of the ship, so that they could be swung back when not in use. As the array of transducers was attached to the vessel, the distance of each transducer from the bottom varied with the movement of the vessel, thus aggravating the already difficult task of determining actual depth relative to position on the bottom. For example, a roll of only three degrees in the hull can raise a transducer mounted on a 40 foot boom as much as two feet or more, thus creating an error of the same magnitude. The importance of correcting such an error is obvious, when one considers that supertankers and other ships often operate with an underkeel clearance of less than one meter, even though overall draft may approach 30 meters.

Some have suggested the addition of a roll sensor to correct this problem. However, this has been generally rejected since it not only fails to eliminate the problem, but adds substantially to the cost and complexity of the system. Others have mounted the booms below the waterline in an attempt to reduce the amount of roll, apparently employing the booms as stabilizers. However, this likewise fails to eliminate the problem and also adds substantially to cost, since it increases drag on the vessel and requires strengthened joints and a steel hull of some size in which proper mounts can be permanently installed.

Previous swath sounding systems have also often lacked in ease of installation, often requiring extensive structural modification to the vessel to properly secure the transducer array. This in turn not only limited the type of vessel available for surveying, but also added to the expense of surveying. Additionally, those vessels which pushed a supported boom in front of the vessel in order to provide ease in installation have employed rigid direct support from the vessel, thus transmitting the full effect of the vessel roll to the sensor array. Moreover, the width of the swath is still limited by several factors including the size of the vessel and the strength of the direct supports, as is the case with all previous swath sounding systems.

Finally, previous swath systems have failed to employ other sensors. This is possibly due either to the sensitivity of such devices to the roll and pitch of the vessel or to the effects of the structural materials contained in the hull and swath system supports, as in the case with magnetometers, which interact with the metal in the hull and swath system supports.

SUMMARY OF THE INVENTION

The present invention provides a method and apparatus which effectively overcomes the deficiencies noted above. According to the invention, a frame is indirectly attached to a vessel so as to follow the vessels forward motion. One or more floats independently support the frame upon which one or more sensors are mounted.

As the frame is only indirectly attached to the vessel, and does not require extensive support therefrom, ready installation and disassembly are possible. Additionally, any distortions in sensor measurements caused by the roll of the vessel or direct contact with its hull are eliminated, since the sensor frame, while an integral part of the vessel, is only indirectly attached thereto. This in turn also eliminates the need for an additional system to stabilize the vessel and allows the sensors to be mounted above the water, thus resulting in a more economical system. Similarly, the present system permits the employment of a much broader swath than heretofore possible, since several booms may be employed without concern for the effect of the vessel's roll.

The fulfillment of these and other details, advantages and objects of the present invention will become more fully apparent from the drawings and a detailed description of the preferred embodiments of the invention.

BRIEF DESCRIPTION OF THE DRAWINGS

FIG. 3 is a plan view of the vessel with the sensor frame in tow;

FIG. 4 is a plan view of another preferred embodiment; and

DETAILED DESCRIPTION

Figure 1:
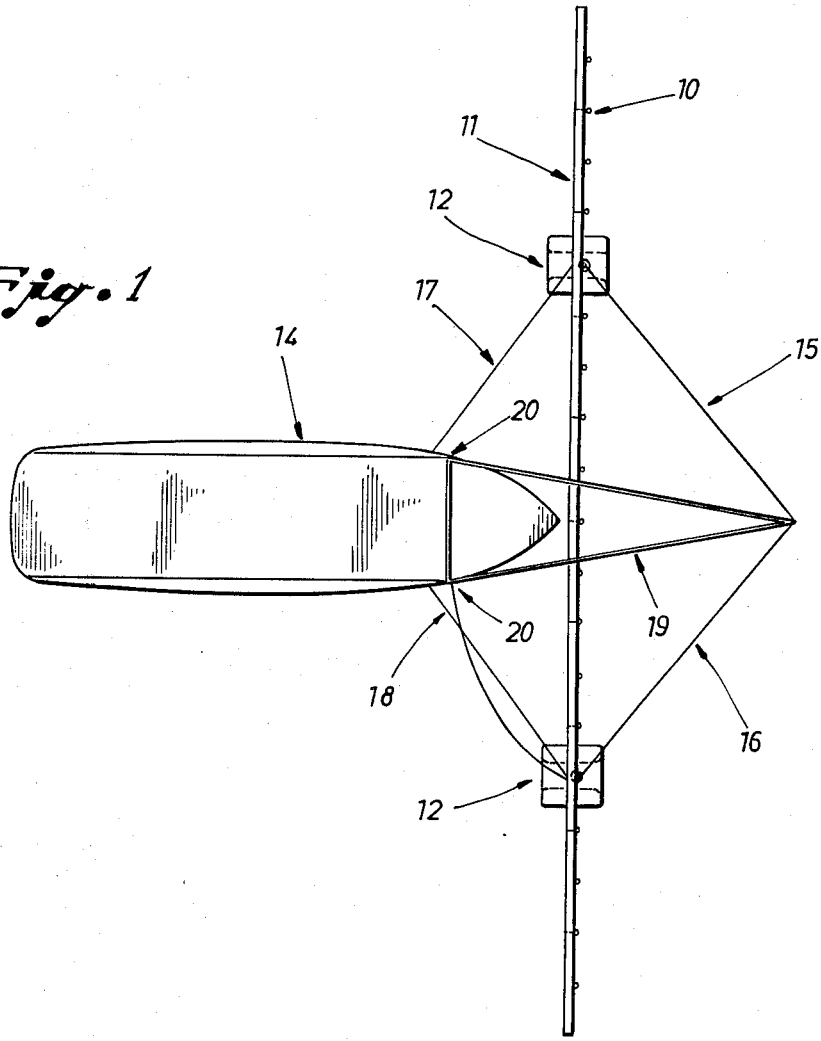
FIG. 1 is a plan view of a preferred embodiment of the invention.
Figure 2:
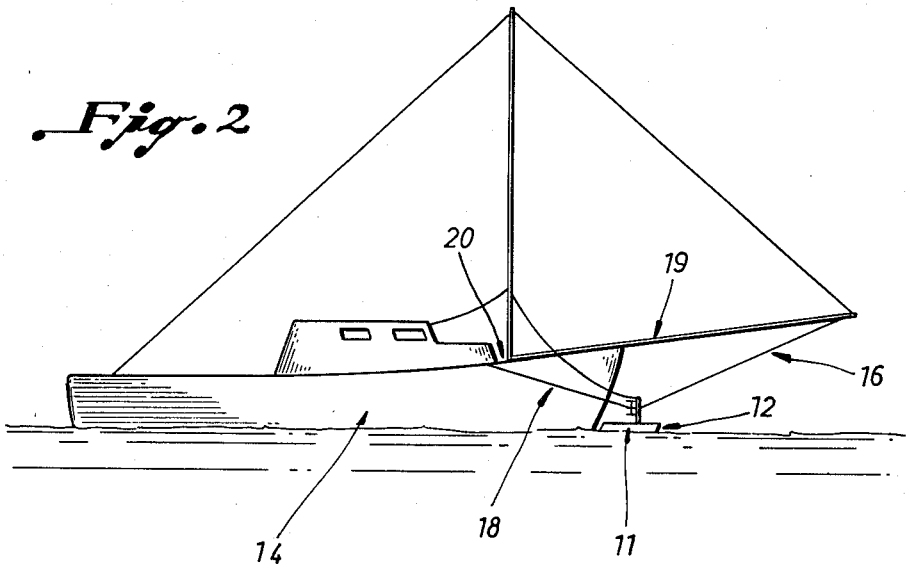
FIG. 2 is a side view of the embodiment shown in FIG. 1.

Reference is now made to FIGS. 1 and 2, which respectively show plan and side views of a preferred embodiment of the invention. According to the invention, in one embodiment transducers or other sensors, 10, are mounted on a boom, 11, that is supported above the water by two or more catamarans, 12, which are rotatably attached to the boom, 11, so as to allow the catamarans to take up the vessel's direction of movement through the water. Thus, the boom, 11, floats freely on the catamarans, 12, so that it is not materially affected by the rolling of the vessel, 14. However, the boom, 11, is constrained by lines 15, 16, 17 and 18, such that it maintains its position relative to the vessel, 14, regardless of how the vessel maneuvers. Thus, the transducer or sensor array remains an integral part of the vessel, yet is materially unaffected by the roll and pitch of the same.

If the sensors or sensing elements, 10, are transducers used for depth sounding, they comprise a series of transmitters or projectors, which essentially change electrical impulses into an acoustic pulse and send that pulse through the water to be reflected off the bottom, and a series of hydrophones or receivers, which pick up the returning echo pulse and convert it back into an electrical impulse.

The specifications for the transducers, 10, are well known in the art. Although they may take advantage of magnetostrictive, electrodynamic or thermoacoustic phenomena, most common transducers are blocks of piezoelectric materials that expand, contract, or change shape when electrical voltages are applied, and vice versa. Consequently, each transducer is normally employed as both a transmitter and a receiver so as to provide more detailed coverage of any given area.

A variety of transducers may be employed in conjunction with the present invention, generally without regard to the effect any material in the vessel may have on the transducers.

Other types of oceanographic sensors or sensing elements may also be employed depending upon the objectives to be accomplished. Length of the sensor frame, added stability and absence of direct contact with the vessel may all be used to advantage. For example, magnetometers may be employed, since they may be held away from the vessel on a nonmetallic boom, which is attached to the vessel by nonmetallic supports or lines. Additionally, any sensor system taking advantage of differential measurements, such as a hydrophone system for determining directional effect, may be employed, since frame length can be quite extensive and since the relation of the boom to the fore and aft line of the vessel may be altered anywhere from 90° to 0°.

The sensors are generally placed on a boom, which is supported by one or more floats. The sensors are preferably mounted on vertical struts which are in turn attached to the boom. The struts are designed to swing back, so that damage to the transducers may be avoided if they are hit by a floating object or underwater obstacle. The number and spacing of the sensors may obviously vary. Thus, the transducer spacing may vary not only with the accuracy desired, but also with the water depth and cone angle of the transducers at the transmitted frequency. By way of example, 21 transducers could be placed 5 feet apart on a 100 foot boom when a frequency of 200 KHz is used and a maximum water depth of 150 feet is expected.

The boom may be made of a variety of materials, either metallic or nonmetallic, depending upon the particular application. It is felt unnecessary to elaborate on the details of such construction, since the details are well known to those skilled in the art.

The floats, which support the boom, are generally free to rotate so that the floats may take up the direction of movement through the water. Although a wide variety of floats may be employed, it is preferable to use a streamlined design to facilitate travel through the water. Thus, the floats should preferably be catamarans or the like.

The floats, 12, may be placed anywhere along the boom depending upon conditions in the survey area. Closer placement of the floats to the end of the boom minimizes the rolling motion likely to occur in a seaway, while placement nearer the center of the boom allows the boom to be of lighter construction, such that the boom is easier to assemble. Thus, in one embodiment of the invention the floats might be placed at the ends of the boom for surveying offshore, while in another the floats could be placed one quarter in from each end of the boom for surveying inland waterways. To this end the floats could be slidably mounted on the boom and locked into place wherever desired.

Of course, only one float may be employed depending upon the size of the boom. However, it is preferable to employ two or more if all of the advantages of the invention are to be realized.

According to the invention, the boom should only be indirectly attached to the survey vessel, so as to allow the boom to maneuver with the vessel, while at the same time remaining unaffected by vessel roll. This may generally be accomplished through the use of tow lines, ropes and the like or other elongated flexible means, which are attached directly to the vessel or appurtenant structures. In one preferred embodiment of the present invention, an A-frame, 19, is installed with heel fittings, (not shown) such that the A-frame projects over the bow like a bowspirit as shown in FIGS. 1 and 2. Two Kevlar lines, 15 and 16, run from blocks at the head of the A-frame to tow points on the boom above the floats. Two further lines, 17 and 18, each of nylon, run from the tow points back to appropriate points on each side of the vessel.

These lines may be shortened or lengthened in relation to each other should it prove desirable or necessary to place the boom at an angle to the fore and aft line of the vessel. According to the present invention such an operation is easily and rapidly accomplished, particularly in view of the floats rotatable mounting in relation to an axis perpendicular to the water surface. Thus, by way of example, if the boom were to be placed at a 45 degree angle with the fore and aft line of the vessel by moving the boom in a clockwise direction as viewed in FIG. 1, line 18 would be shortened to pull the right side of the boom (as viewed in FIG. 1) in and line 17 lengthened to accommodate for the changed position of the left side of the boom. Similarly, lines 15 and 16 would also be adjusted, as necessary, to ensure that the boom maintained the same position relative to the vessel, as previously discussed.

Additionally, the foregoing operation could be facilitated by attaching lines 17 and 18 to locking reels or other devices well known to those skilled in the art, such that lines 17 and 18 could be readily lengthened or shortened and so be used to maneuver the boom angle in relation to the vessel, yet be held in place when the boom's angle to the vessel is not being changed. By way of example, two ratcheted winches could be mounted on the sides of vessel where lines 17 and 18 are attached. Lines 17 and 18 would be respectively tied to or form a part of the winch line of each winch. By winding up or letting out the winches, the length of lines 17 and 18 could be shortened or lengthened, as desired. Of course, each winch should be equipped with a locking mechanism, so that the relationship of the boom to the vessel can be held constant.

The dimensions of the appurtenant structures, such as the A-frame, will be a function of the vessel size and shape. Similarly, any support of the appurtenant structures will be a function of the type and size of structure used to provide indirect support to the boom. The key in each case lies in the need to constrain the boom to maintain its position with regard to the forward motion of the vessel, yet avoid the effect of the vessel roll and allow easy disassembly and installation. Thus, in one embodiment of the invention the apex of the A-frame would be approximately 25 feet forward of the bow and supported by a line suitably placed from the mast or superstructure or, alternatively, from a vertical frame mounted to heel fittings used to support the A-frame.

As indicated in FIG. 1, the heel fittings are preferably located astern of the bow at 20 in order to take full advantage of the beam of the vessel. The type of heel fittings or other connecting apparatus will be a function of the type of vessel employed. However, it is unnecessary to further elaborate on these since the details of such fittings are well known to those skilled in the art.

When the sensor system is not in use, it may be towed astern or alongside of the vessel as shown in FIG. 3. One or more lines, 22, are bowsed in enough to steer the frame and its supporting floats clear of the vessel's side. As the floats are rotatably mounted so as to rotate about an axis vertical to the boom, the boom readily takes up the direction of the vessel as shown in FIG. 3. Also, as shown in FIG. 3 the forward float may be placed at an angle to the fore and aft line of the vessel such that it acts in conjunction with line 22 to maintain the frame in a desired location. To assist in maintaining such an angle the floats may be equipped with rudders.

Other equipment may be attached to the boom. For example, when employed with a swath sounding system, the boom is generally fitted with cable channel to hold the transducer cables in place. Of course, other cables are employed to connect the sensors with measuring and other appropriate devices on the ship. A catwalk may also be installed to allow easy access to the sensor system. Additionally, heave sensors can be attached to the boom. Although the boom floats freely on its floats so that it is not affected by the rolling of the attendant vessel, the floats are still subject to the vertical motion of the waves. This vertical motion can be detected by heave sensors, typically embodying one or more accelerometers, which measure and transmit the amount of vertical movement in signal form. Consequently, any offshore version should be fitted with heave sensors, preferably one over each float, in order that accuracy may be better preserved.

The type of survey vessel employed in the present invention may vary widely. In fact any craft suitable for the overall purpose of the survey may be employed, since no particular adaptations are required to support the sensors. Thus, full attention may be given to factors such as range, speed, working facilities, capacity etc. without regard to the need for specifically supporting the sensor array.

Referring now to FIG. 4, it is possible in many cases to broaden the sweep even more if the following configuration is employed. One or more booms, 11, are towed on the beam of the vessel, 14, through use of lines 31, 32 and 33, which run between the vessel, 14, and an inboard catamaran, 35.

The inboard catamaran 35, is constrained by lines 31–33 such that its fore and aft line is angled slightly away from the fore and aft line of the vessel, 14. As the vessel moves ahead the flow of water past the inclined hulls, 41, of the catamaran, 35, holds the catamaran, 35 in the required position. By way of example, the inboard catamaran, 35, could be held some 50 feet off the beam of the vessel.

The boom 11, supports the sensors or sensing elements, 10, as before and is rotatably attached to catamarans 12 and 35. While being towed to and from the survey site, the boom 11 may be coaxially located with the fore and aft line of the catamaran 35 such that catamaran 12 would be well astern of the vessel if catamaran 35 is attached as shown in FIG. 4. Alternatively, the catamarans 35 and 12 may be placed in any one of a number of positions so as to vary the angle between the boom 11 and the fore and aft line of the vessel. However, as already noted, during operation it is necessary to place the boom 11 in a particular position as for example in the case of a hydrographic survey when it is desirable to have the boom 11 perpendicular to the fore-aft line of the vessel.

In order to ensure ease of placement, the rotation of the boom 11 on the inboard catamaran 35 may be controlled by an electric motor 36, which is itself remotely controlled and powered from the vessel, 14 through use of one or more power cables 37 or other appropriate means. To this end a worm gear, 42, is attached to the shaft 43 of the electric motor, 36. The worm gear 42 is in turn meshed with a gear, 44, which is integrally mounted on a shaft (not shown) which the boom 11 rotates about the catamaran, 35. Thus, rotation of the electric motor shaft 43 causes the boom 11 to rotate in relation to the catamaran 35.

In operation the inboard catamaran 35 is towed at an angle as determined by lines 31–33, as previously noted. The position of catamaran 35 in relation to the vessel is determined in part by the flow of the water past the catamaran 35. Thus, as already noted, the catamaran 35 can be placed at an angle to force it out from the vessel while still being constrained by lines 31–33. Once the catamaran 35 is in position, the boom 11 is brought into perpendicular relation with the fore and aft axis of the vessel 14 through use of the electric motor, 36.

Of course, many variations of this embodiment are possible. For example, catamaran 35 could be the same size or even smaller than the outboard catamaran, 12, rather than larger than catamaran 12 as shown in FIG. 4. Also, a gasoline engine or hand cranked mechanism may be employed in lieu of an electric motor, though the latter is preferred due to ease of use and control. Additionally, several booms may be employed, possibly with varying lengths or with portions of overlap.

Although the preferred embodiment only employs elongated flexible means, such as lines 15–18, to constrain the frame, 11, once it is maneuvered into position, the floats or catamarans may be provided with outboard motors, electric motors or the like coupled to a propeller, a rudder or other appropriate mechanism in order to maintain the position of the floats. In fact, such devices might be employed independently of the elongated flexible means to maintain the position of the frame relative to the vessel, depending upon the accuracy required in maintaining such a position. However, simplicity, ease of operation and accuracy will generally dictate the use of elongated flexible means without the use of added steering and propulsion mechanisms, other than the possible use of rudders.

Figure 5:
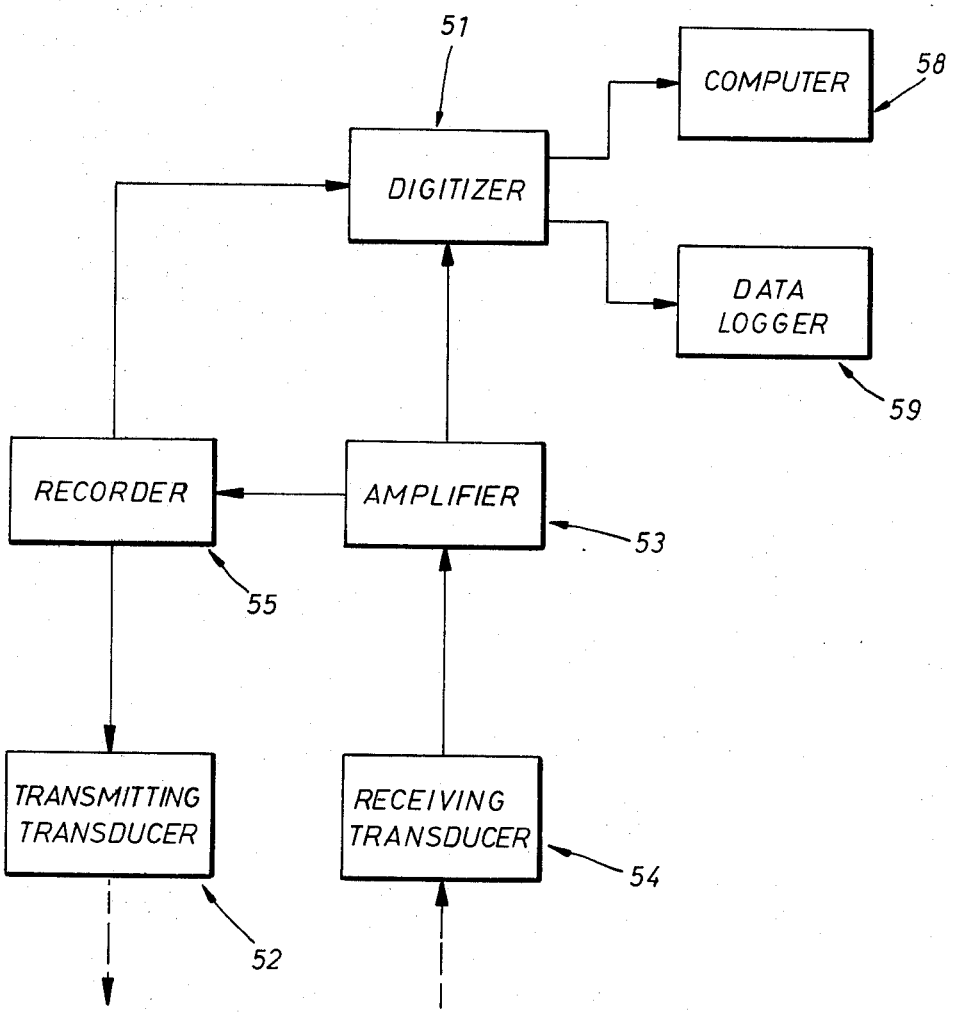
FIG. 5 is a schematic of a typical recording and display mechanism employed with swath sounding systems.

The array of sensors may be attached to any one of various recording devices. Illustrative of this is an embodiment employed with the transducer array, which is generally connected to a recording mechanism and power supply. The general outline of a typical system for depth sounding is shown in FIG. 5. A recorder/display, 55, with a timing mechanism controls the emission of the sound pulses from the projector or transmitting transducer, 52 and simultaneously sends those signals to a digitizer, 51. The echo response is amplified by amplifier, 53, after being received by the hydrophone or receiving transducer, 54, and before being sent to both the recorder/display unit, 55, and the digitizer, 51. The depth measure sent to the digitizer is then forwarded to a computer 58 or a data logger 59 for later transfer to an onshore computer. Of course, one or more appropriate sources of power (not shown) may also be required.

Although the foregoing system is in itself sufficient without the aid of computers or other devices, particularly where only one or two transducers are employed, the bulk of data presented by a typical swath sounding system is another matter.

A conventional survey crew is normally kept fully employed processing the output of just one transducer. However, a typical swath survey employing 21 transducers will produce twenty times as much data for the same amount of field work. In fact during an 8 hour day a 21 transducer system will typically make over 6 million depth measurements. A depth, however, is meaningless until it can be combined with a position to form a sounding, and it is this process which proves difficult in existing swath systems.

Three methods of presentation have been used, including multiple analog traces, digital printouts, and area shading, but none has proven entirely satisfactory. As to the first of these, if the multiple analog traces have the same zero the record gives a three dimensional effect, where the seabed slopes across the direction of movement; however if the bed is flat, or the slope is up or down the ship's track, all the traces are superimposed, such that if any shown an anomaly it is impossible to identify the transducer which caused it. Where only four or five transducers are used their records have sometimes been displayed with off-set zeroes; this however becomes very confusing when going across a slope so that the echoes overlap, either with each other or with adjacent transmission pulses. Moreover, the method proves to be impractical with more than five transducers.

The area shading method also provides an analog record, but one in which the shade of grey on a strip chart represents the depth. This gives a form of contour map, but is limited by the number of shades of grey that can be clearly represented. This is insufficient to show the degree of detail that is required over the range of depths that are normally encountered, so data has been shown twice, in parallel bands on the same strip chart, with the contour interval five times greater on one band than on the other. The result is complex and difficult to interpret without considerable experience.

The third alternative is a digital printout of the depths collected, normally limited to a 1 or 2 second sample by the speed of the line printer, and therefore subject to the increased error rate resulting from use of any sampling system. Sometimes a form of contouring is provided, but the printout is confusing as the scale is different on each axis. It is possible to read off depths and plot them on a chart, but the task of doing so is tedious and time consuming. In fact, it would seem unlikely that the manpower would be available to do this on a regular basis. Yet, until such a plot is made the significance of the depths cannot be appreciated.

With any of these systems the facility is normally provided to record the depth data, frequently in conjunction with position, on paper or magnetic tape, so that further processing may be undertaken by computer. The task of handling this processing in an efficient manner, however, is essentially left unsolved.

Although any of the foregoing systems may be employed with the present invention, it is preferable to eliminate many of the foregoing problems and use a system producing a multiply shaded colored analog trace which allows the hydrographer to interpret and select the contours that he wishes to show. Given the quantity and diversity of data involved, human judgment is thus appropriately combined with electronics to provide the data in a useful form with a minimum consumption of cost and time.

Although a variety of systems could produce an appropriate analog trace, as aforementioned, the following is a preferred embodiment of such a system, which comprises the following sub-systems: depth measurement, data collection and data processing.

The Depth Measurement sub-system is a modified version of a depth-measurement sub-system manufactured in Innerspace Technology, Inc. of One Bohnart Place, Waldwick, N.J. under the name Autoplot 412. The design is modular, to facilitate the assembly of systems with varying numbers of transducers, a concept which also facilitates field maintenance since most problems can be resolved by replacing a single module. Each module comprises a transceiver on one board, with time variable gain; automatic gain control and a preset gain control, a digitizer on three boards, and a four digit display of either feet or meters, which is set to zero when bad data is recognized.

The main frame, 36" high for a 21 module system, in a 19" rack, contains the power supplies for all modules and all the operator controls. These include a four digit thumbwheel switch for entry of the speed of sound, a gate width switch (2, 4, 8 and 16 feet or 1,2,4 and 8 meters), a three digit switch and "Enter" button to allow entry of an initial depth to facilitate acquisition of the seabed when there is a strong mid water reflector, and a mode selector—direct, gated or auto. The gate in each module is locked to the seabed but opens automatically when contact is lost; in the auto mode it reverts to direct after 2,4 or 8 missed echoes, as selected by the operator.

An important element of the sub-system is a buffer board which stores the output of each transducer in the internal format of the computer and then transfers all depth measurements once a second under direct memory access—a technique which transfers all the data in less than 5 milliseconds.

The system is calibrated by a calibration transducer, mounted horizontally at one end of the boom and directed towards an acoustic reflector at the other end. To determine the speed of sound in water it is only necessary to switch the calibration transducer in place of one of the sounding transducers; the speed of sound control may then be adjusted until the appropriate depth display shows the distance between the calibration transducer and the acoustic reflector. Corrections for draft and tide are applied in the computer.

In one preferred embodiment the Data Collection subsystem comprises the following components: a Hewlett-Packard 9845T desktop computer, with 187146 bytes of Read/Write memory, monochromatic graphics Cathode ray tube, monochromatic graphics read only memory, built in 80 column thermal printer, dual tape cartridge transports, input/output read only memory, mass storage read only memory, and real time clock; an input/output expander for example a Hewlett-Packard 9876A, a dual flexible disc drive, for example a Hewlett-Packard 9895A; a plotter, such as a "DP3" put out by Houston Instruments of Austin, Tex., a Helmsman's Display; input interfaces from position system and compass; and appropriate software.

The computer is programmed to compute position once a second and to use this position to compute off-track error for display on the Helmsman's Display. The plotter is then updated and the position of each end of the boom plotted, so that the plot shows each swath and builds up a complete picture of the area covered. The depths are entered once a second and transferred, in conjunction with time, position, and ship's heading, to a file on the floppy disc, while the computer cathode ray tube gives a graphic display of the current depths, updated once a second. A choice of displays is provided; one might be termed a 'goalpost' display, in which project depth is the crossbar and actual depth is shown above and below, while the other shows the soundings in plan view, with depths less than project depth shown by asterisks, and those greater by minus signs. This presentation is approximately to scale but no correction is made for variations in heading or course. Either display may be printed on the thermal printer in a matter of seconds, by pressing a special function key.

In a preferred embodiment the data processing subsystem comprises the following components: a Hewlett-Packard 9845C desktop computer, with a 317 820 bytes of Read/Write memory, a color graphics Cathode ray tube, a color graphics read only memory, an interactive light pen, a built in 80 column thermal printer, a dual tape cartridge transport, an input/output read only memory, a mass storage read only memory, and a real time clock, a dual flexible disc drive, (such as a Hewlett-Packard 9895A), a plotter, a ½" industry compatible tape transport, and appropriate software.

The data is handled in two passes. The first calculates the position of each transducer at each position input, by applying the appropriate offsets, and then interpolates the position of each intermediate depth, corrected for height of tide. Each such reduced sounding is stored on the second disc. The second pass reads each sounding sequentially and plots it on the Cathode ray tube, showing its depth by color. In some applications it would be appropriate to have a violent color contrast at project depth. For example, blues and greens could be used below project depth and yellows and reds employed above. The Cathode ray tube would also show the coordinate intersections and such previously entered details as dredged channels and survey limits.

The display should give a varied graphic display of the contours, but it is not to be expected that these contours could be translated immediately to the chart, particularly where the bottom is flat, since there might be a large number of distinct shoals close together that should be generalized into one large one. It would also be very time consuming to contour by computer because of the immense number of data points involved. Rather, contour drawing in this situation is a function where the skill and experience of the hydrographer will be superior to the computer and it is better that he should interpret the contours that he wishes to show. This could be readily accomplished through use of a light pen. Having done this, the hydrographer can then select the soundings that will best supplement the contours, with the option of selecting either the shoal point or the mean of all depths measured within an area. These contours would also form the basis of the calculation of quantities, the area enclosed being multiplied by the means distance above or below project depth. Thus, through selective use of a display depicting depth through color, the hydrographer is able to overcome many of the deficiencies of prior art methods.

Many details as to the specification and interconnection of the foregoing recording and computing device are not included, since they are well known to those skilled in the art. Similarly, many variations on such recording and computing devices are possible, as is also well known by those skilled in the art. However, as noted it is preferable to employ a data processing system and display, such that the data processor is linked to the transducers so as to produce a sounding comprising a depth measurement for each position. Additionally, the display should be so programmed as to indicate each depth measurement by a unique color.

Although the above description has been largely restricted to an apparatus and method employing depth sounding transducers, the present invention clearly encompasses systems and methods employing a variety of oceanographic sensors and recording and computing devices. The foregoing description has been directed to the particular preferred embodiment in accordance with the requirements of the Patent Statutes for the purposes of illustration and explanation. It will be apparent, however, to those skilled in the art that many modifications and changes in the apparatus and procedure set forth will be possible without departing from the scope and spirit of the invention. It is the applicant's intention that the following claims be interpreted to embrace all such modification and variations.

What is claimed is:

1. A hydrographic swath surveying system comprising:

(a) an A-frame attached and projecting over the bow of a vessel;

(b) a boom;

(c) two or more catamarans for rotatably mounting the boom for rotation about an axis vertical to the boom;

(d) two or more Kevlar lines extending from the apex of the A-frame to tow points on the boom above the point where the catamarans are attached;

(e) two or more nylon lines attached at one end to the tow points of the boom and on the other end to the side of the vessel such that the Kevlar and nylon lines act in conjunction to pull the boom along the vessels path; and (f) one or more transducers mounted on the boom so as to rotate about an axis parallel to the water surface.

2. The apparatus of claim 1 wherein the A-frame is supported by a line extending from the superstructure of the vessel.

3. The apparatus of claim 1 wherein the A-frame is supported by heel fittings attached to both sides of the vessel at a point forward of the midsection of the vessel where the beam of the vessel is close to its maximum.

4. A method of deploying a hydrographic swath surveying system for use with an attendant vessel such that the sensing elements are independent of the roll, pitch and magnetic effects of the vessel yet can remain in a fixed relation to the vessel, said method comprising the steps of:

(a) rotatably attaching two or more catamarans to a boom for rotation about an axis vertical to the boom;

(b) rotatably mounting one or more transducers on the boom for rotation about an axis parallel to the surface of the water;

(c) attaching an A-frame to the sides of a vessel at a point where the beam of the vessel is close to its maximum and so that the A-frame projects over the bow of the vessel;

(d) towing the boom to a survey site by attaching at least one catamaran to side of the vessel;

(e) releasing the boom from the vessel at the survey site;

(f) attaching two or more Kevlar lines from the apex of the A-frame to tow points on the boom above the points where the catamarans are attached; and (g) attaching two or more nylon lines at one end to the tow points on the boom and at the other end to the sides of the vessel such that the Kevlar and nylon lines act in conjunction to pull the boom along the vessel's path.

5. An oceanographic sensor system for use with an attendant vessel such that the sensing elements are independent of the roll, pitch and magnetic effects of the vessel yet can remain in a fixed relation to the vessel, said sensor system comprising:

(a) a frame attached to and projecting over the bow of the vessel;

(b) a boom supported by two or more floats, the floats being mounted for rotation about an axis perpendicular to the boom, the axis being substantially vertical in calm water;

(c) at least two primary flexible lines extending from the frame to tow points on the boom;

(d) two secondary flexible lines attached at one end to the tow points of the boom and at the other end to the vessel, the primary and secondary lines being adjusted to tow the boom ahead of the vessel at a preset angle to the fore and aft line of the vessel; and (e) one or more sensing elements pivotally mounted on the boom for rotation about the horizontal axis of the boom.

* * * * *